United States Patent [19]

Iyeta

[11] 3,943,476

[45] Mar. 9, 1976

[54] PLUNGER DAMPING MEANS FOR AN ELECTROMAGNETIC SOLENOID

[75] Inventor: Motoi Iyeta, Hamakita, Japan

[73] Assignee: Nippon Gakki Seizo Kabushiki Kaisha, Hamamatsu, Japan

[22] Filed: Dec. 10, 1974

[21] Appl. No.: 531,367

[30] Foreign Application Priority Data

Dec. 11, 1973 Japan ..... 48-139914
July 24, 1974 Japan ..... 49-87862[U]

[52] U.S. Cl. ..... 335/239; 335/240; 335/274

[51] Int. Cl.[2] ..... H01F 7/18

[58] Field of Search ..... 335/239, 227, 230, 240, 335/251, 258, 261, 260, 262, 274, 279; 317/123

[56] References Cited

UNITED STATES PATENTS

| | | | |
|---|---|---|---|
| 2,853,659 | 9/1958 | Herion | 335/262 |
| 2,931,617 | 4/1960 | Jamieson | 335/240 X |
| 3,103,612 | 9/1963 | Marmo | 335/240 |
| 3,509,505 | 4/1970 | Zagrzjewski | 335/274 |
| 3,517,360 | 6/1970 | Gray | 335/230 |
| 3,665,353 | 5/1972 | Campbell | 335/274 |

*Primary Examiner*—G. Harris
*Attorney, Agent, or Firm*—Cushman, Darby & Cushman

[57] ABSTRACT

An electromagnetic solenoid with a yoke defining a hollow cylinder, an electromagnetic coil wound around this cylinder for connection to a power source, a plunger inserted in the cylinder for sliding movement therein when the coil is energized and having a needle-like rod extending through the yoke bottom, the plunger and cylinder each having a confronting surface which is faced with a confronting surface of the other during the sliding movement. A plurality of spaces are formed on the confronting surface of at least either the cylinder or the plunger, and a braking substance consisting of a highly viscous liquid is applied to the confronting surfaces of the plunger and cylinder. Spring means may be operatively provided about the plunger to return the slidingly moved plunger to its original position. Upon energization of the solenoid, the downward movement speed of the plunger is limited by the braking substance. The spaces serve to keep the liquid braking substance therein and insure the braking effect of the substance. Thus, the smooth slow stroke of the plunger is free of impact and any noise resulting from the rod hitting the yoke end is eliminated. This solenoid can be prepared in a compact size and is suitable for slowly driving a light-weight object.

10 Claims, 12 Drawing Figures

PLUNGER DAMPING MEANS FOR AN ELECTROMAGNETIC SOLENOID

BACKGROUND OF THE INVENTION

1. Field of the Invention:

The present invention pertains to an electromagnetic solenoid, and more particularly to a compact solenoid for slowly driving a light-weight object with substantially no impact upon hitting a surface at the end of its travel.

2. Description of the Prior Art:

An electromagnetic solenoid of the prior art is arranged so that a plunger is inserted within the core of an electromagnetic coil to be operative so that this plunger is moved forwardly and backwardly with the supply and suspension of electric current to the coil. It is usual that the time required for the plunger to complete one whole stroke is a matter of about a millisecond. Efforts have been made in the past for a further reduction of this length of time of stroke.

On the other hand, it is known that oil pressure as well as air pressure apparatus are widely utilized as a driving means where quick movement is not required. Such an apparatus invariably is considerably complicated in its structure and accordingly tends to be large in size and requires a great deal of labor in its maintenance.

In order to solve these problems of known driving means which do not need quick driving, and to obtain a compact size solenoid for slow driving, especially a light-weight object the inventor has made an extensive research in developing a new type of solenoid as the driving means for accomplishing these objects and has succeeded in attaining them.

SUMMARY OF THE INVENTION

It is the primary object of the present invention to provide an electromagnetic solenoid whose plunger takes a relatively long time before it completes a required whole stroke.

Another object of the present invention is to provide an electromagnetic solenoid of the type described which allows slow movement of the plunger to be achieved easily and at a low cost without requiring substantial alteration of the structure of known electromagnetic solenoid or known manufacturing process or manufacturing equipment.

Still another object of the present invention is to provide an electromagnetic solenoid of the type described, which is substantially free of impact and impact noise during its operation, especially at the forward tip of the actuated plunger.

Yet another object of the present invention is to provide an electromagnetic solenoid of the type described which is compact in size and simple in structure and which is suitable especially for driving a light-weight object.

These as well as other objects, features and advantages of the present invention will become apparent by reading the following description when taken in conjunction with the accompanying drawings.

DETAILED DESCRIPTION OF THE PREFERRED EMBODIMENTS

The present invention will hereunder be described in detail first with respect to an example of the electromagnetic solenoid designed for slow driving of a light-weight object by referring to the accompanying drawings.

Figure 1:
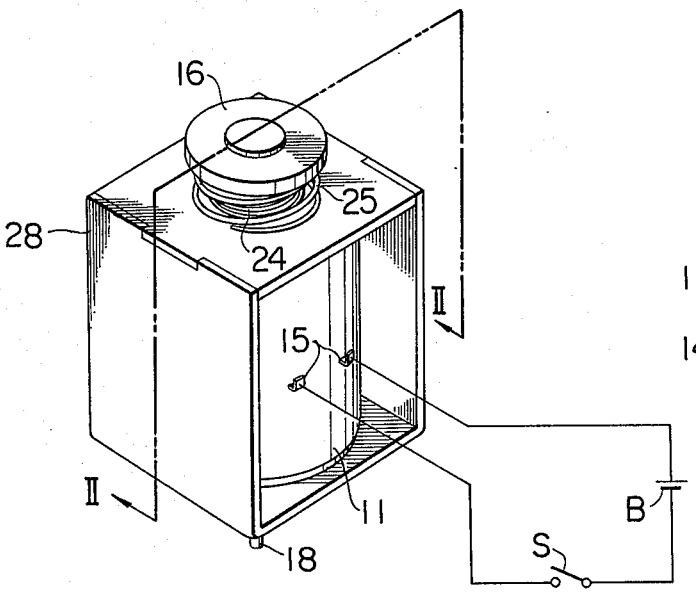
FIG. 1 is a diagrammatic perspective view of a preferred example of the electromagnetic solenoid, with its terminals being connected to a power source shown in the form of circuitry.
Figure 2:
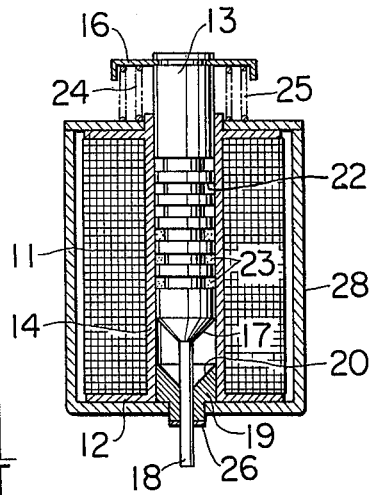
FIG. 2 is a longitudinal sectional view of the electromagnetic solenoid of FIG. 1, taken along the line II—II in FIG. 1.

In FIGS. 1 and 2, the electromagnetic solenoid according to the preseent invention comprises, in a similar way to known a solenoid of this type, an electromagnetic coil 11, a yoke 12 around which this coil 11 is wound, and a plunger 13 slidably inserted in yoke 12.

The yoke 12 has a hollow cylinder 14 formed integrally with the yoke 12 and centrally thereof. The longitudinal wall of the cylinder 14 defining the upper and the lower open ends of this cylinder are bent at these ends to extend outwardly in the direction of crossing the longitudinal wall of the cylinder at right angle to thereby form upper and lower flanges. The electromagnetic coil 11 is positioned between these upper and lower flanges and is wound around the yoke defining cylinder 14 and is protected around the coil 11 by an appropriate insulating protective material in a known manner. The opposite ends which function as terminals of the coil 11 are exposed to the outside of the protective material for connection to a power source such as batteries B via switch S.

The plunger 13 is snugly and slidably journelled within the cylinder 14. Plunger 13 includes a spring-supporting disk 16 having a diameter greater than that part of the plunger which is journelled in cylinder 14 and is connected to that part via a stem fixed to the plunger head, concentrically with the plunger. On the opposite end, i.e. at the lower end portion, plunger 13 has a tapered portion 17. From the apex of this tapered portion 17 extends a needle-like rod 18 on the central longitudinal axis of the plunger. The yoke end 19 has a tapered recess 20 having a shape complementary with the tapered portion 17 of the plunger 13 for receiving tapered portion 17 snugly therein, a through-hole 21 (shown in FIG. 3) having a diameter large enough for the passage of the rod 18 therethrough is formed centrally and longitudinally of the yoke end 19. This yoke end 19 is tightly fitted into the lower end portion of the cylinder 14 to substantially close this lower end to thereby prevent the plunger from casually slipping out of the lower end of the cylinder 14. The rod 18 of the plunger 13 is of such a length as is able to protrude for a substantial distance beyond the bottom end of the through-hole 21 of the yoke end 19 at the time of actuation of the plunger as described below.

The plunger has a plurality of ring-shaped grooves 22 formed circumferentially on the outer surface thereof which faces the inner surface of the cylinder 14 during sliding movement of the plunger. Each of these circular grooves 22 has its inner diameter smaller than the diameter of the rest of plunger 13 and has its outer diameter equal to the diameter of the plunger. Each of these grooves 22 has a substantially square cross section. A braking substance 23 of a highly viscous liquid is applied to the confronting surfaces of the plunger and cylinder, some of the braking substance staying in the space defined by these grooves 22. This braking substance may be silicon oil or grease. Silicon oil or grease having a viscosity of 200,000 – 1,000,000 centistokes (cs) (measured at 25°C) has been found most suitable. As such silicon oil, there are available "TSF 451" (tradename) produced by Tokyo Shibaura Electric Co., Ltd. of Japan and "KF 96H" (tradename) produced by The Shin-etsu Chemical Industries, Ltd. of Japan. Such a braking substance, at the time of movement of the plunger 13, serves to reduce the speed of movement of the plunger to prolong the time required of the plunger 13 to cover the required distance of stroke. The aforesaid grooves 22 are provided on the circumference of the plunger 13 at such positions as will not be exposed to the outside of the cylinder 14 when the plunger 13 is moved toward the bottom of the cylinder 14.

The returning movement of the plunger 13 within the cylinder 14 is carried out by the action of a coiled compression spring 24 which is placed between the spring-supporting disk 16 of the plunger 13 and the upper flange of the yoke 12. To this end, the coiled spring 24 is of a spring force sufficient for causing the return of the plunger 13 to its normal position against the weight of the plunger itself and against the braking force exerted by the braking substance 23 to the plunger 13. A coiled compression spring 25 may further be provided concentrically with the coiled spring 24 on the outer side of the latter. This coiled spring 25 is inhibits the plunger 13 from hitting the yoke end 19 with any substantial impact. To this end, the coiled spring 25 is shorter in length than the coiled spring 24 and is disposed on the side of the yoke 12, leaving a space between the upper end of the spring 25 and the disk 16. Immediately before the tapered portion 17 of the plunger 13 hits the yoke end 19, spring 25 is compressed against the spring-supporting disk 16 to further reduce the speed of movement of the plunger 13.

Next, the behavior of the electromagnetic solenoid of the present invention will be explained. As the electromagnetic coil 12 is connected to the power source such as a battery B by closing the switch S, the plunger 13 which has been held in its uppermost normal position by the actions of the coiled spring 24 will be forced to move downwardly, in accordance with Fleming's Left Hand Law, within the cylinder 14 while compressing the coiled spring 24 against the spring force of this coiled spring. During this movement of the plunger 13, the speed of the downward movement is subjected to a braking force caused by the resistance created by the highly viscous substance 23 which is placed between the external surface of the plunger 13 and the inner wall surface of the cylinder 14, and accordingly, the speed of movement of the plunger 13 will be reduced.

As the tapered portion 17 of the plunger 13 approaches closer to the yoke end 19, this plunger starts compressing the coiled spring 25. As the plunger 13 approaches closer to the yoke end 19, its speed of movement will increase because of the acceleration of speed due partly to its own weight and partly to the action of the energized coil 11. However, owing to the compression of the coiled spring 25, the movement speed of the plunger 13 will be forced to decrease, thus preventing the plunger from severely hitting the yoke end 19. In this way, there occurs substantially no severe hitting, and accordingly no hitting noise is produced by the running tip of the rod 18 of the plunger 13.

Figure 4:
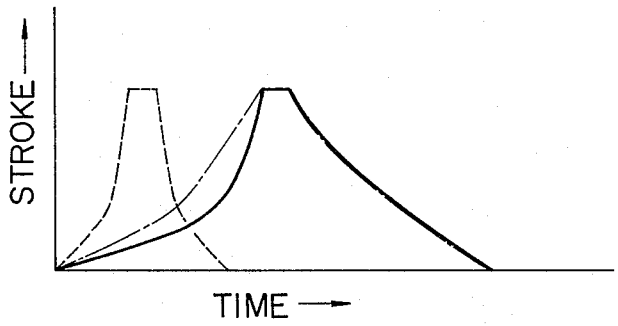
FIG. 4 is a chart for explaining the behavior characteristics of the electromagnetic solenoids with and without a time-constant circuit, as compared with the behavior characteristics of known electromagnetic solenoid.
Figure 5:
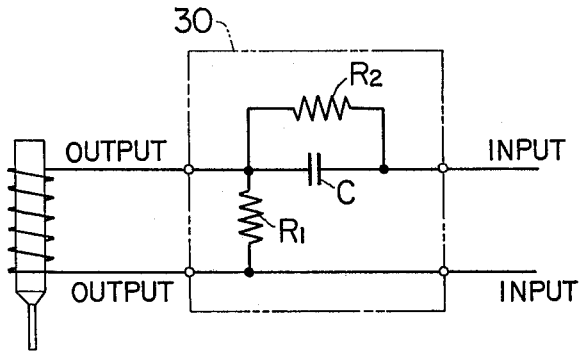
FIG. 5 is a diagrammatic explanatory structural arrangement of the electromagnetic solenoid of this invention equipped with a time-constant circuitry.

Then, as the supply of the electric current to the electromagnetic coil 11 is suspended, the plunger 13 will be forced to return to its initial normal position by the restoring forces of the two coiled springs 24 and 25 applied to the plunger via its spring-supporting disk 16. In this preferred example of the electromagnetic solenoid, a stopper 26 is fixed to an appropriate site of the rod 18 of the plunger 13 to be located outside the bottom of the yoke end 19, so that during the returning movement of the plunger 13, the stopper 26 is brought into contact with the bottom of the yoke end 19 to thereby control the distance covered by the plunger 13 in its last half of stroke, i.e. its returning upward movement. Also, in order to make the torque of the plunger 13 so as to be close to being constant throughout the first one half of the whole stroke at least the downward movement, a time constant circuit generally indicated at 30 as shown in FIG. 5 is provided between the terminals of the electromagnetic solenoid and the power source B. By applying a voltage $V_1$ to the time constant circuit 30, this voltage $V_1$ will become attenuated progressively, on the output side, until it drops to a voltage $V_2$, depicting a curve which is determined by the time constants of capacitor C and resistors $R_1$ and $R_2$ of this circuit 30 so that the voltage will become constant after this level $V_2$. By driving the electromagnetic solenoid with such an output, it is possible to let the solenoid perform a substantially rectilinear movement as shown by the dot-dash lines shown in FIG. 4. This FIG. depicts the behavior of known electromagnetic solenoid, which shows a very quick movement to cover the whole stroke as shown by broken lines. In contrast with the much slower and smoother behavior of the electromagnetic solenoid of the present invention having no time-constant circuit. The solenoid having a time-constant circuit shows a further slow and smooth stroke as indicated by dot-dash lines in FIG. 4.

Figure 10:
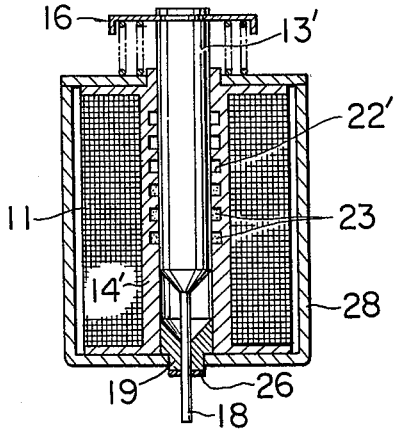
FIG. 10 is another embodiment of the solenoid of FIG. 2 in which space-constituting grooves are provided on the inner wall surface of the cylinder.

According to another example of the electromagnetic solenoid of the present invention, the cylinder 14' is provided at its inner wall surface with a plurality of grooves 22' instead of being provided with the grooves on the circumference of the plunger 13' as shown in FIG. 10. The circumference of the plunger 13', in this second example, is of a continuously smooth surface. It will be understood, no doubt, that an electromagnetic solenoid having such cylinder and plunger can function in exactly the same manner as does the preceding example.

Figure 7:
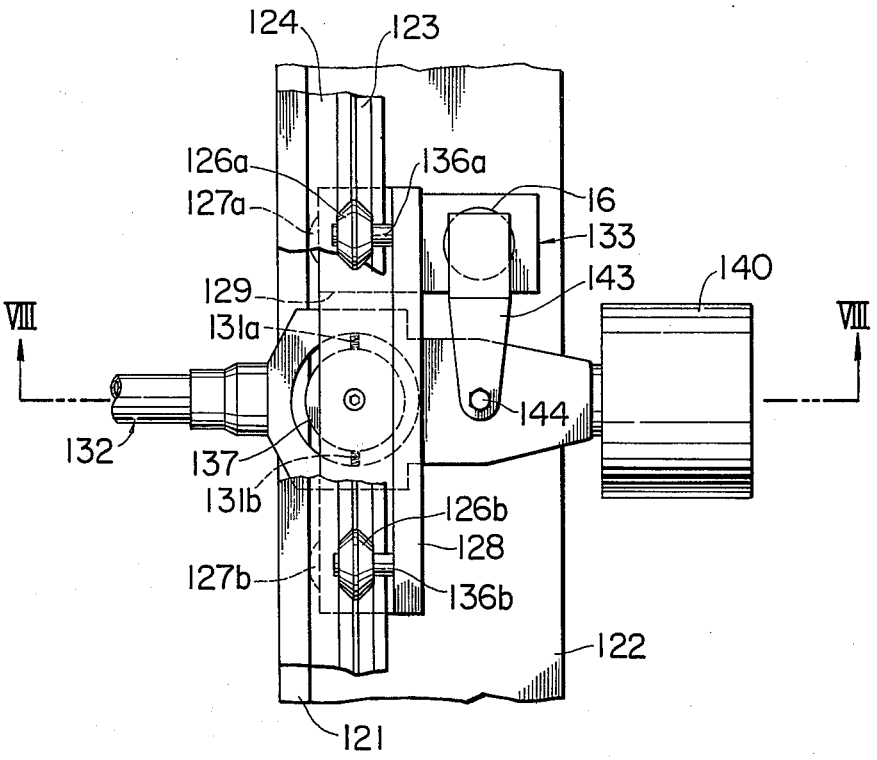
FIG. 7 is a diagrammatic plan view, with parts broken away, showing the arrangement of a linear tracking tone arm using the electromagnetic solenoid of the present invention as an arm lifter.
Figure 8:
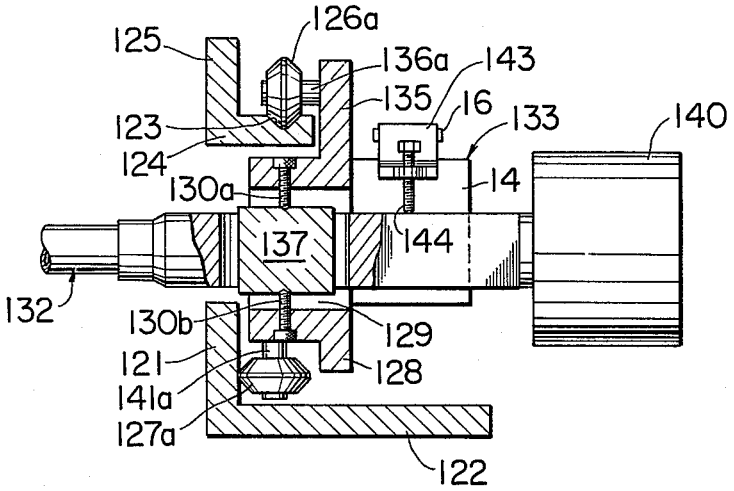
FIG. 8 is a similar side view, partly in section, of the arrangement of FIG. 7 taken along the line VIII—VIII in FIG. 7.
Figure 9:
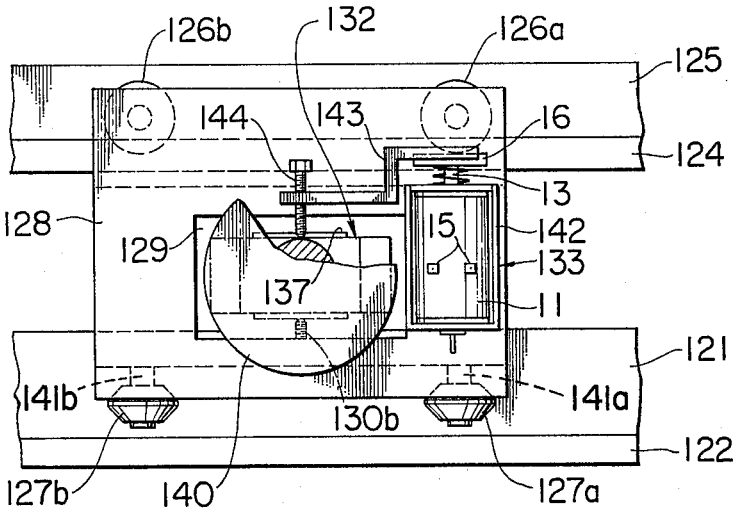
FIG. 9 is a similar rear view, partly in section, of the arrangement of FIG. 7.

The electromagnetic solenoid as stated above is quite useful in driving a very light-weight object at a low speed and for being installed in a very limited space. FIGS. 7 through 9 show an example of such use of the electromagnetic solenoid of the present invention with or without the time-constant circuit, which is utilized as an arm lifter in a gramophone record player having a linear tracking arm. As the arm lifter mechanism for lifting and lowering a pickup element from and to the surface of a disk record, there are those known devices of the type comprising a cylinder and piston and using oil or air as the actuating fluid. In view of the fact, however, that in the linear tracking system, the movable support for movably supporting the tone arm is mounted on a screw or a rail, the lifter mechanism as a whole tends to become quite complicated in structure. Such being the circumstance in the art at present, it has been difficult to put into practice on a commercial basis a linear tracking system which is capable of effectively eliminating the development of tracking errors of the pickup means. In a record player having the ordinary type tone arm also, the above-stated fact serves to complicating the lifter-operating mechanism, resulting in an increase in the manufacturing cost.

Referring now to FIGS. 7 through 9, there is shown an example of the tone arm lifting mechanism in the linear tracking system, using the electromagnetic solenoid as the tone arm lifter. The illustrated main portion of the mechanism for supporting the movable support of the tone arm comprises a substantially L-shaped, angular supporting base frame member 122 having a vertical wall surface 121, a substantially L-shaped, angular suspension frame member 125 having a horizontal supporting rail 124 provided with a groove 123 which is of a substantially V-shaped cross section, a pair of suspension pulleys 126*a* and 126*b* which are received in and suspended by the V-shaped groove 123 of the horizontal supporting rail 124, a movable frame 128 rotatably carrying a pair of supporting pulleys 127*a* and 127*b* movably contacting the vertical wall surface 121 of the angular supporting base frame member 122, a tone arm 132 supported, in an opening 129 formed through the thickness of the lower part of the movable frame 128 in the lower portion thereof, by horizontally swingable pivots 130*a*, 130*b* and by vertically swingable pivots 131*a* and 131*b*, these four pivots constituting gimbals support, as shown in FIGS. 7 through 8, and an arm lifter 133 fixed to the movable frame 128 on one side of the tone arm 132 for vertically moving this tone arm.

The upper portion of the movable frame 128 is provided with a stepped portion formed by removing about two thirds of the thickness of the movable frame 128 off the upper portion thereof to avoid the interference by the supporting rail 124 off the suspension frame member 125. Shafts 136*a* and 136*b* are secured to the vertical wall surface 135 of the stepped portion in such a way that the centers of the breadths of the respective suspension pulleys 126*a* and 126*b* are positioned so as to be slightly offset toward the left side from the center of the thickness of the movable frame 128 as viewed in FIG. 8. In the opening 129 provided in the lower part of the movable frame 128 is movably secured the tone arm 132 supported at its fulcrum 137 by the aforesaid vertically swingable pivots 131*a*, 131*b* and the horizontally swingable pivots 130*a*, 130*b*. The tone arm 132 has an arm pipe (not shown) for carrying a pickup head (not shown) at its one end. At the other end of this tone arm 132 is secured a counter weight 140 so that the tone arm 132 may be supported horizontally normally. At the lower part of the movable frame 128 are rotatably secured supporting pulleys 127*a* and 127*b* via shafts 141*a* and 141*b* secured to the movable frame 128 so that these pulleys are movably in contact with the vertical wall surface 121 of the supporting base frame member 122.

Figure 3:
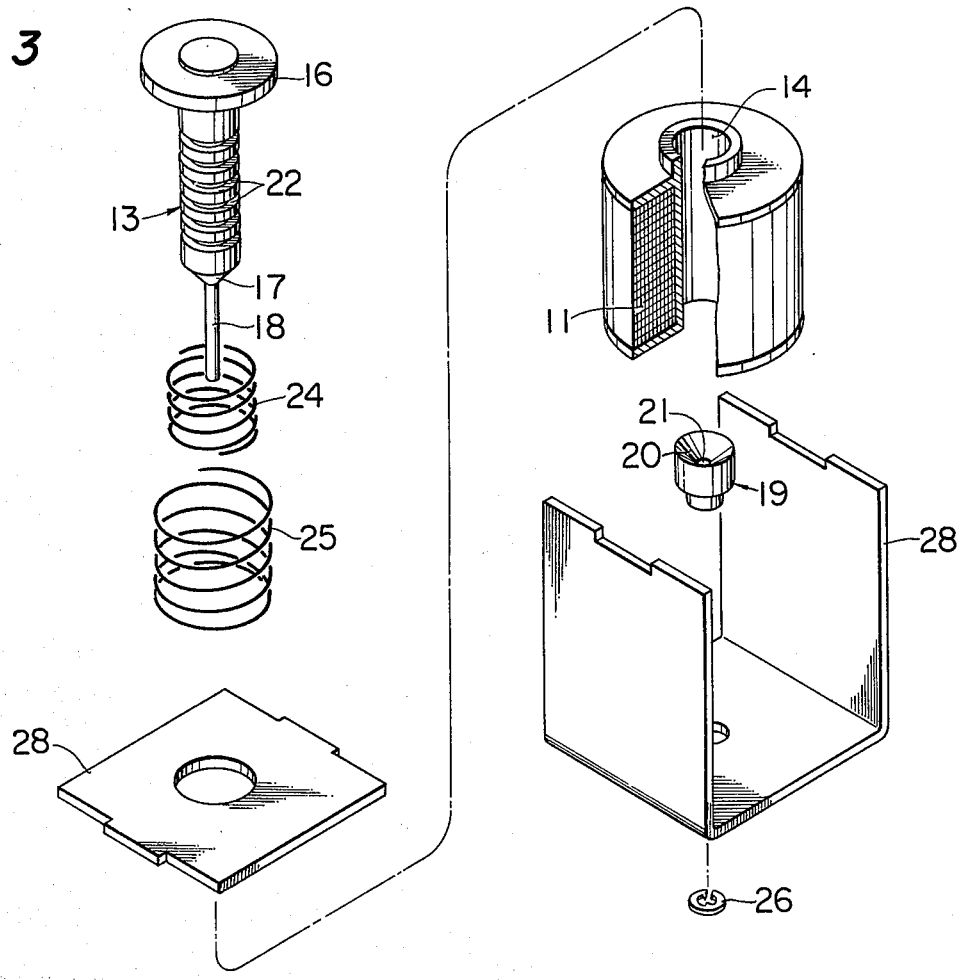
FIG. 3 is an exploded perspective view of the electromagnetic solenoid of FIG. 1.

The lifter is indicated generally by reference numeral 133 and it is fixed to one side of the movable frame 128 on one side of the tone arm 132. This lifter 133 is of a structure as shown in FIGS. 2 and 3 and is fixed by screwing its housing 142 to the movable frame 128. To the spring-supporting disk 16 of the plunger 13 is fixed a coupling plate 143. At one end of this coupling plate 143 is provided an adjustment screw 144 threadably passed through this plate 143 for the adjustment of the stroke covered by the plunger 13. The lower end of this adjustment screw 144 contacts the tone arm 132 at a position offset toward the counter weight 140 from the fulcrum 137 of this tone arm 132. As the electromagnetic solenoid is energized by being connected to a power source the battery shown in FIG. 1, its plunger 13 is forced to move downwardly as discussed previously. Along therewith, the coupling plate 143 as well as the adjustment screw 144 are moved downwardly also, so that the pressing of the counter weight side of the tone arm 132 by the forward end of the screw 144 causes the pickup side of the arm to swing upwardly about its fulcrum 137. Then, as the supply of electric current to the electromagnetic solenoid is suspended, the plunger 133 actuates the coupling plate 143 and adjustment screw 144 to move upwardly from their lowered positions, so that accordingly the pickup side of the tone arm 132 is caused to move downwardly, and the sound reproduction stylus (not shown) will be brought into contact with a sound groove of the record disk supported on a record player.

After completion of a record playing, or after the record playing is suspended midway, a DC voltage is applied to the electromagnetic coil 11 shown in FIG. 2 by the signal intended for automatically returning the tone arm 132 to an arm rest (not shown), for example by a signal which is generated when optical groove-tracing of the sound groove of the record disk arrives at the final sound groove or by a signal generated upon actuation of the automatic play-suspending mechanism, and the plunger 13 is caused to move. When this occurs, the forward end of the adjustment screw 144 which is provided in the coupling plate 143 pushes vertically downwardly that point on the tone arm 132 which is offset toward the counter weight 140 from the supporting fulcrum 137 of the tone arm. As a result, the sound reproduction stylus (not shown) secured to the pickup head (not shown) of the tone arm 132 is lifted upwardly for a sufficient distance from the depth of the sound groove of the record disk (not shown). While keeping this condition, the movable frame 128 supporting the tone arm 132 which has been moving toward the center of the record disk is now moved in the reverse direction along the supporting base frame member 122 and the angular suspension frame member 125 which are fixed to a machine frame (not shown), thereby moving the tone arm 132 backwardly toward the arm rest not shown. Thereafter, the energization of the electromagnetic solenoid is suspended. Now, the tone arm 132 will be placed downwardly onto the arm rest.

Figure 6A:
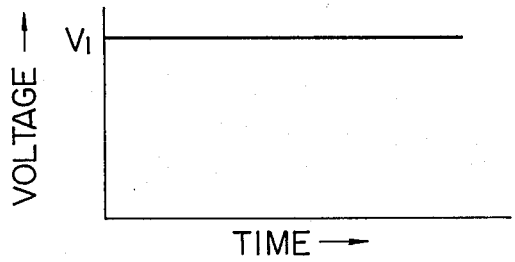
FIGS. 6A and 6B are charts for explaining the behavior of the electromagnetic solenoid of FIG. 5.
Figure 6B:
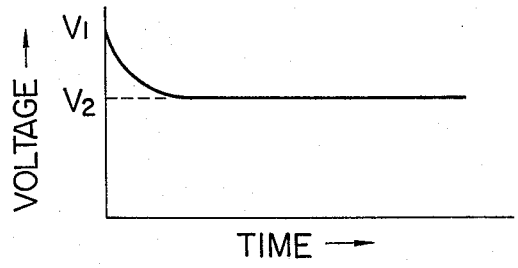

For an automatic playing, the electromagnetic solenoid is energized in the same manner as stated previously. Then by a signal generated upon detection of the size, etc. of the record disk just when the sound reproduction stylus of the pickup head provided at the foremost end of the tone arm 132 supported on the movable frame 128 arrives precisely above the first sound groove of a record disk, the solenoid is de-energized. Thus, the stylus of the pickup head of the tone arm 132 is brought into contact with the required site of the record disk without this reproduction stylus sustaining any big impact since it is moved in accordance with the movement characteristics of the solenoid of the present invention as shown in FIGS. 6A and 6B.

Figure 11:
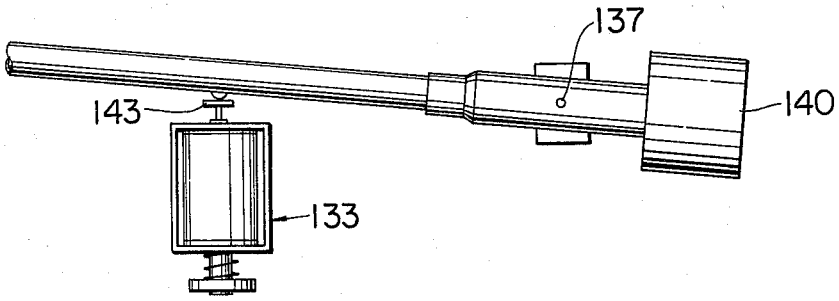
FIG. 11 is another arrangement of a linear tracking tone arm using the solenoid of the present invention.

In the tone arm lifting arrangement described above, the pickup head is adapted to be lifted up by pressing the tone arm downward at a point offset from the fulcrum of the tone arm toward the counter weight. However, arrangement may be provided, in place of the above-mentioned arrangement, that the tone arm is pushed upwardly at a point offset toward the pickup head from the fulcrum of the tone arm to lift the pickup head as shown in FIG. 11. In this latter instance, the direction of the solenoid is reversed as compared with the embodiment shown in FIGS. 7 to 9, the coupling plate 143 being fixed to the tip end of the rod 18 so as to support that portion of the tone arm offset toward the pickup head from the fulcrum of the tone arm. The movement of the tone arm is substantially the same as in the case of the former embodiment.

Description has been made with respect to an instance wherein the electromagnetic solenoid of the present invention described above is used with a linear tracking arm as an example that this solenoid is utilized effectively for slowly driving a lightweight object. This electromagnetic solenoid, needless to say, may be used in any other type of record player or any other apparatuses requiring this solenoid.

I claim:

1. An electromagnetic solenoid comprising:

a yoke having a hollow cylinder, an electromagnetic coil wound around said cylinder and connectable to a power source, a plunger slidably inserted in said cylinder and rendered movable in said cylinder upon energization of said coil, said plunger and cylinder each having a confronting surface which is faced by a confronting surface of the other of said plunger and cylinder during sliding movement of the plunger, the confronting surface of at least one of said plunger and cylinder having a plurality of separated grooves formed therein each extending in a direction perpendicular to the direction of sliding movement and separated along said direction of sliding movement, and a highly viscous braking substance positioned in said grooves for reducing the speed of movement of said plunger in said cylinder.

2. An electromagnetic solenoid according to claim 1, in which said space comprises a plurality of grooves formed on the inner circumference of said cylinder, and said plunger has a smooth continuous circumference.

3. An electromagnetic solenoid according to claim 1, in which spring means engages said plunger to reduce the movement speed of the plunger when the solenoid is energized.

4. An electromagnetic solenoid according to claim 2, in which said braking substance is selected from silicon oil and silicon grease having a viscosity of 200,000 –1,000,000 cs measured at 25°C.

5. An electromagnetic solenoid according to claim 2, in which said braking substance is selected from silicon oil and silicon grease having a viscosity of 200,000–1,000,000 cs measured at 25°C.

6. An electromagnetic solenoid according to claim 3, in which said spring means comprises two spring members, one of which exerts its spring force throughout the movement of the plunger and the other exerts its spring force when the plunger approaches the end of its movement toward the bottom of said cylinder.

7. An electromagnetic solenoid according to claim 6, in which said plunger has a needle-like rod extending through the bottom of said cylinder, and said rod has attached thereto stopper means in the portion protruding beyond the bottom of the cylinder.

8. A lifter for a tone arm of a record player having an electromagnetic solenoid of claim 1, in which said plunger has a coupling member secured thereto and an end of this coupling member away from said solenoid is in contact with the tone arm, whereby the tone arm is movable with the movement of said plunger.

9. A driving apparatus having an electromagnetic solenoid of claim 1 and arranged to move an object by the movement of the plunger of said solenoid.

10. An electromagnetic solenoid according to claim 1, in which said electromagnetic coil has a time constant circuit between said coil and a power source connectable to said coil.

* * * * *